United States Patent [19]

Hwang

[11] Patent Number: 4,984,599

[45] Date of Patent: Jan. 15, 1991

[54] FORDING FRAMES OF AN UMBRELLA

[76] Inventor: Wen C. Hwang, 2F, No. 9, Alley 23, Lane 135, Si-Ta Rd., Hsinchu, Taiwan

[21] Appl. No.: 370,189

[22] Filed: Jun. 22, 1989

[51] Int. Cl.[5] ..... A45B 19/00

[52] U.S. Cl. ..... 135/25 R; 135/26

[58] Field of Search ..... 135/25 R, 25 A, 26, 135/27, 22, 23

[56] References Cited

U.S. PATENT DOCUMENTS

| | | | |
|---|---|---|---|
| 744,476 | 11/1903 | Burgess | 135/25 R |
| 829,858 | 8/1906 | Eaton | 135/25 R |
| 838,092 | 12/1906 | Ely | 135/26 |
| 912,206 | 2/1909 | Thayer | 135/25 R |
| 1,264,010 | 4/1918 | Calusinski | 135/25 A |
| 1,447,815 | 3/1923 | Pedersen | 135/25 |
| 2,334,330 | 11/1943 | Janowsky | 135/26 |
| 3,848,740 | 11/1974 | Weber | 135/25 R |
| 4,077,421 | 3/1978 | Schultes | 135/25 R |

FOREIGN PATENT DOCUMENTS

| | | | |
|---|---|---|---|
| 717989 | 1/1932 | France | 135/25 R |
| 333753 | 10/1958 | Switzerland | 135/25 N |
| 194479 | 3/1923 | United Kingdom | 135/25 R |
| 753177 | 6/1956 | United Kingdom | 135/25 R |

*Primary Examiner*—Henry E. Raduazo

*Attorney, Agent, or Firm*—Notaro & Michalos

[57] ABSTRACT

The present invention relates to an umbrella with improved fording frames which includes an upper frame and a lower frame, and is characterized in that a sliding frame is provided at the connected portion of the upper frame and the lower frame; where the other end of the sliding frame being connected to a sliding hole of a pulling frame which connects with a pushing frame at the same end. And wherein the total length of the sliding frame and the pulling frame is equal to the length of the upper frame minus the length of the sliding hole. While the umbrella is opened, the frames can be provided in a smooth curve for being covered by the shade completely.

1 Claim, 4 Drawing Sheets

FORDING FRAMES OF AN UMBRELLA

FIELD AND BACKGROUND OF THE INVENTION

The present invention relates in general to an umbrella which has an improved folding frame, and which, after opening, provides for the complete covering of the frame.

In the prior art shown in FIG. 5, the known structure for an umbrella frame has a lower frame member C, an upper frame member A and a second frame member B. In use, the lower frame member C is raised to raise the upper frame member A and the second frame member B, which opens the umbrella. As shown in FIG. 5 , a concave area is formed between the upper member A and the second frame member B. In this area, the covering material (not shown) does not touch the frame entirely and this is the reason why this type of umbrella has been unacceptable to date.

SUMMARY OF THE INVENTION

It is the purpose of the present invention, therefore, to mitigate and/ or obviate the above-mentioned drawbacks in the manner set forth in the description of the preferred embodiments.

A primary objective of the present invention is to provide an umbrella with an improved folding frame which is constructed so that it extends smoothly when open, without any concave spaces therealong.

Further objectives and advantages of the present invention will become apparent as the following description proceeds. The features of novelty of the invention are characterized in the claims annexed to and forming a part of this disclosure.

DESCRIPTION OF THE PREFERRED EMBODIMENTS

Figure 1:
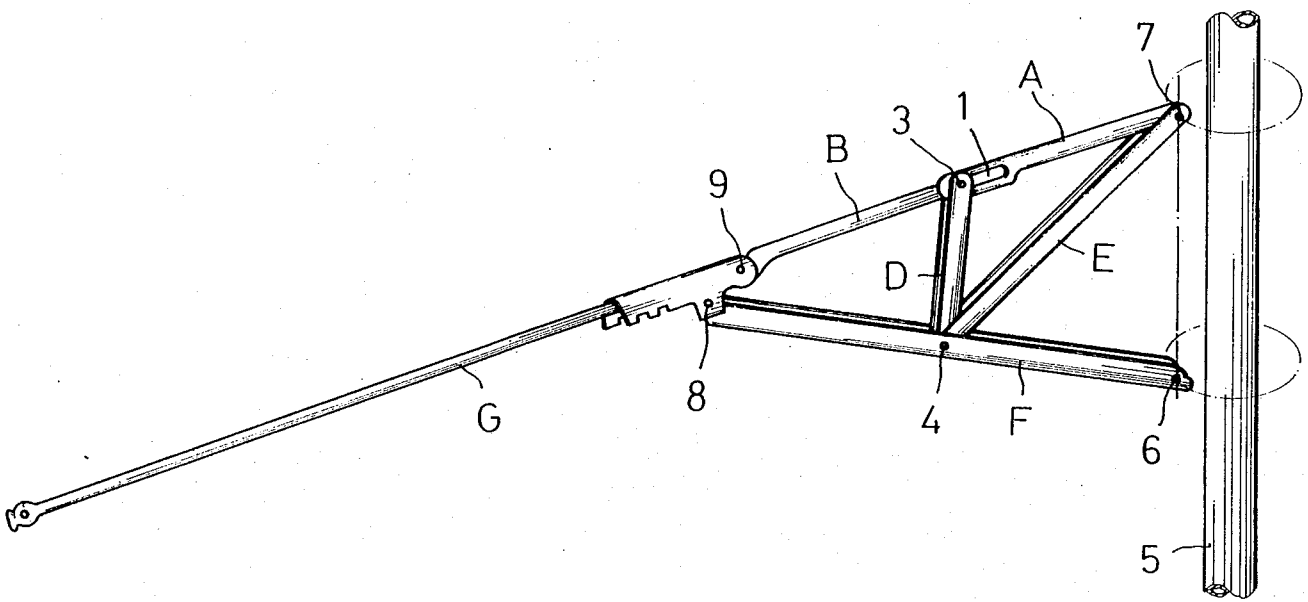
FIG. 1 is a side perspective view of a frame in its open position and according to the present invention.
Figure 2:
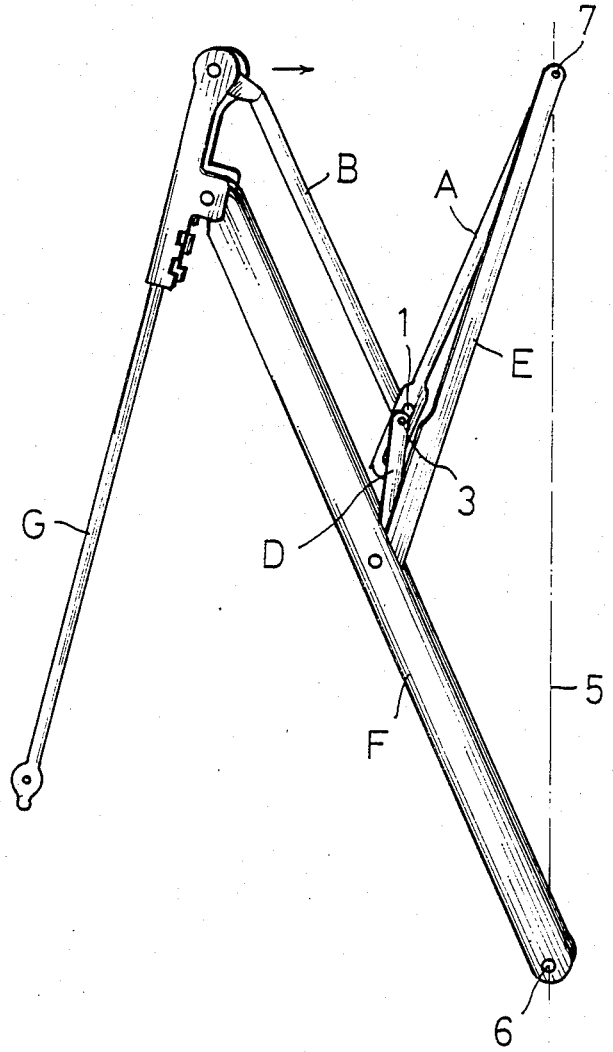
FIGS. 2 and 3 are views of another embodiment of the frame, in respective intermediate and closed positions, and with FIG. 3 being schematic.
Figure 3:
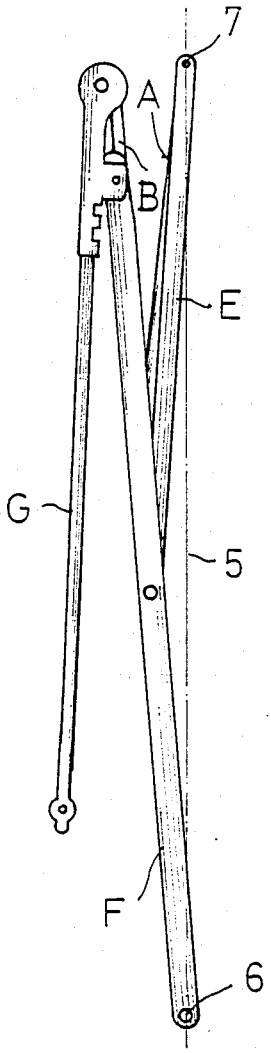

Referring to FIGS. 1 to 3, where the same reference characters are used to designate the same or similar parts, the present invention is characterized in that a sliding frame member D is provided with one end at a connection 4 of an upper frame member E and a lower frame member F. The other end of the sliding frame member D is connected to the junction between a pulling frame member A and a pushing frame member B, at a connection 3. The pulling frame member A is formed with a sliding hole 1 thereon which slidably receives the correction 3.

As clearly shown in the figures, the upper frame member A has first and second ends with the sliding hole 1 at the second end. The upper frame member E has a first (upper) end which is pivotally connected at a connection 7 to the first end of the pulling frame member A and to an upright support 5 of the umbrella.

The lower frame member F also has first and second ends with the connection 4 being intermediate at these ends. The first end of lower frame member F is connected at a sliding connection 6 to the support 5. The pushing frame member B has a first end connected at the connection 3 to the sliding frame member D, and a second end connected at 9 to a fixture which is also pivotally connected at 8 to the second end of the lower frame member F. The fixture is connected to an arm G which as shown in FIG. 1 also extends in alignment with the pushing frame member B and the pulling frame member A, when the frame is in its open position.

Figure 4:
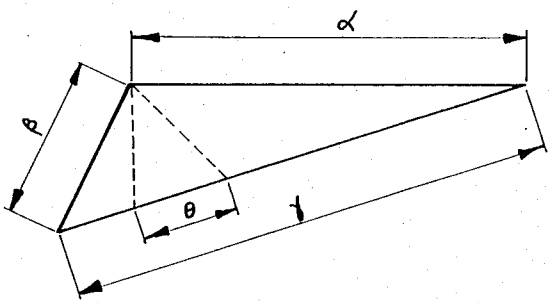
FIG. 4 is an explanatory view of the relationship between the frame members of the frames in FIGS. 1 to 3.
Figure 5:
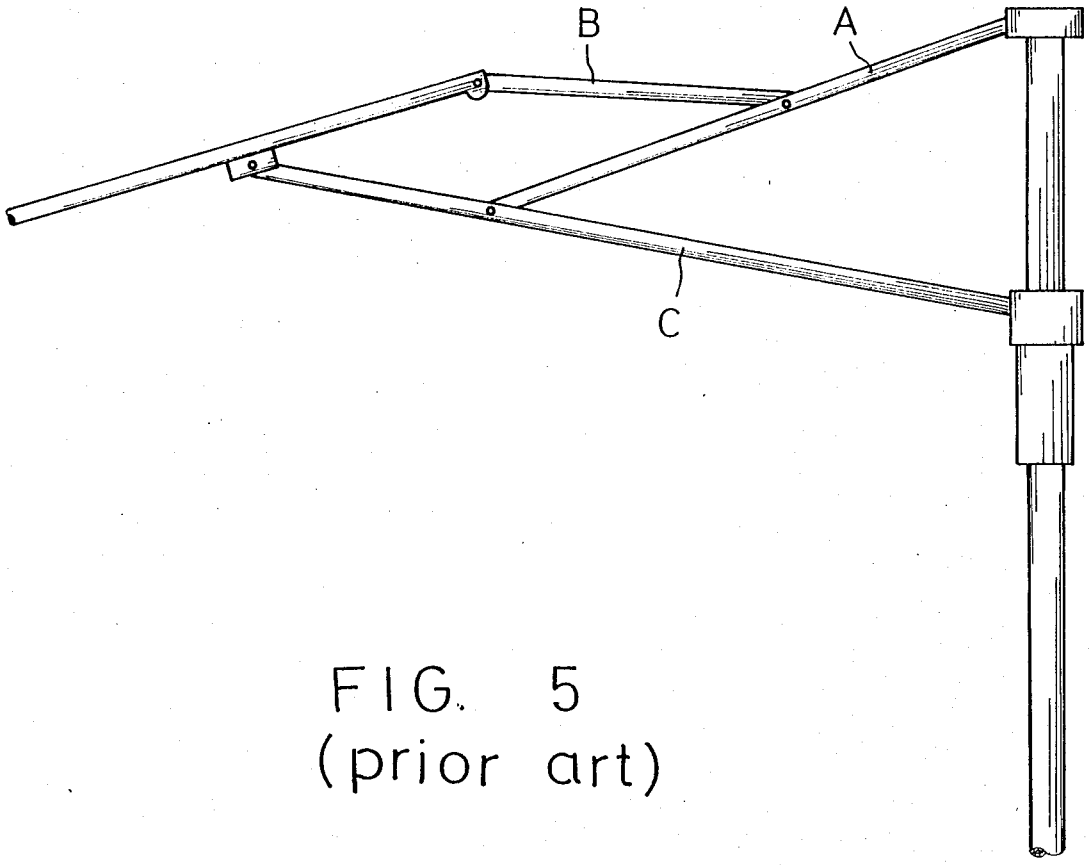
FIG. 5 (prior art)
FIG. 5 is a side view of a prior umbrella in its open position.

As the umbrella of the present invention closes (see FIGS. 2 and 3 which operates the same way as FIG. 1), it can be seen that the lower frame member F is moved downwardly on support 5, and the pulling frame member A becomes aligned with the sliding frame member D and they both drop into the member E which has an upwardly open recess therein as clear from FIG. 1. The theory of the present invention can be seen in FIG. 4 where $\alpha+\beta>\gamma$; and $\alpha+\beta-\gamma=\phi$. The length of the sliding hole 1 of the pulling frame member A must be equal to $\phi$. During closing of the umbrella, the connection 3 of the sliding frame member B moves upwardly in the sliding hole 1 of the pulling frame member A and reaches the other end of the hole. In the meantime, the total length of the sliding frame member and pulling frame member is just equal to the length of the upper frame member minus the length of the hole. The umbrella is, therefore, closed without problems.

On the other hand, as the umbrella is going to be opened, sliding connection 6 of the lower member F will be moved upwardly as will the sliding frame member D and the pulling frame member A, which now rise upwardly and separate from the upper frame member E.

When raised and open the frame has a smooth continuous, curved upper shape for supporting the covering material (not shown). Thus, the main purpose of the present invention is achieved.

As various possible embodiments might be made of the above invention without departing from the scope of the invention, it is to be understood that all matter herein described or shown in the accompanying drawings is to be interpreted as illustrative and not in a limiting sense. Thus it will be appreciated that the drawings are exemplary of preferred embodiments of the invention.

I claim:

1. An umbrella frame which, in an open position, smoothly and continuously supports a covering material thereon, comprising:

a pulling frame member (A) having a first length, a first end and a second end with a sliding hole (1) in said second end having a second length and extending part of the first length of said pulling frame member;

a sliding frame member (D) having first and second ends and a third length between said first and second ends;

a pushing frame member (B) having first and second ends, said first end of said pushing frame member being pivotally connected at a first connection (3) to said first end of said sliding frame member, said first connection being slidably engaged in said sliding hole of said pulling frame member;

a lower frame member (F) having first and second end, the second end of the sliding frame member being pivotally connected at a second connection (4) to said lower frame member at an intermediate position between said first and second ends of said lower frame member, the second ends of said lower frame member, said pushing frame member being pivotally connected to each other;

an upper frame member (E) having a first end pivotally connected at a third connection (7) to said first end of said pushing frame member, said upper frame member having a second end pivotally connected at said second connection to said sliding frame member and to said lower frame member, said upper frame member having a fourth length between said first and second ends of said upper frame member which is equal to the first length plus the third length minus the second length;

said frame having an open position with said first connection at an outer end of said sliding hole adjacent said second end of said pulling frame member and said sliding frame member, said pulling frame member and upper frame member forming a triangle, said pushing frame member and said pulling frame member extending in a substantially smooth continuous fashion for continuously supporting a covering material of an umbrella having said frame;

said frame having closed position with said pulling frame member being substantially aligned with said sliding frame member, said pulling frame member and sliding frame member extending substantially along said upper frame member and said first connection being at an inner end of said sliding hole spaced away from the second end of said pulling frame member.

* * * * *